US006273773B1

(12) United States Patent
Bourke

(10) Patent No.: US 6,273,773 B1
(45) Date of Patent: Aug. 14, 2001

(54) SCUBA DIVER'S MARKER BUOY AND DRY BOX

(76) Inventor: Vincent A. Bourke, 3516 Jasmine Trail, Arlington, TX (US) 76017

( * ) Notice: Subject to any disclaimer, the term of this patent is extended or adjusted under 35 U.S.C. 154(b) by 0 days.

(21) Appl. No.: 09/390,139

(22) Filed: Sep. 3, 1999

(51) Int. Cl.[7] ..... B63B 22/16; B63B 22/20
(52) U.S. Cl. ..... 441/6; 441/28
(58) Field of Search ..... 441/1, 6, 23, 26, 441/28, 32, 44, 45, 35; 114/254

(56) References Cited

U.S. PATENT DOCUMENTS 3,730,544 * 5/1973 Hyman ..... 280/11.37 L
4,123,813 * 11/1978 Adams ..... 9/8 R
4,144,606 * 3/1979 McIntyre ..... 9/8
4,228,556 * 10/1980 Searls ..... 9/14
4,638,593 * 1/1987 Garcia ..... 43/54.1
5,257,954 * 11/1993 Mullisen et al. ..... 441/89

* cited by examiner

*Primary Examiner*—S. Joseph Morano
*Assistant Examiner*—Andrew Wright
(74) *Attorney, Agent, or Firm*—Crutsinger & Booth

(57) ABSTRACT

A dive buoy/dry box assembly comprising a hollow canister-like main float assembly having a hinged latchable air-tight sealing lid, a collapsible marker flat and mast removably attached to the lid, a collapsible staff and ballast weight removably attached to the bottom of the float assembly and a buoy line storage reel detachably mounted surrounding the float assembly in a horizontal plane, the marker flat, mast ballast weight and staff all storable in said float assembly when collapsed.

13 Claims, 7 Drawing Sheets

SCUBA DIVER'S MARKER BUOY AND DRY BOX

TECHNICAL FIELD

This invention relates to scuba diving equipment and more particularly to a combination dive buoy-dry box structure useful to mark a submerged scuba diver's location and as a water-tight "dry box" for temporary dry storage of materials and objects handily accessible to a diver while in the water as well as a convenient storage compartment for the dive flag and buoy stabilizer weight bar.

BACKGROUND OF INVENTION

Dive buoys and flags are important safety devices used to warn boaters that divers are in that area of the water so that they may be alert for the divers or preferably to stay clear of the area. In some jurisdictions use of dive flags is required by law. The dive flag must be large enough and displayed high enough to be seen by boaters from at least about 100 yards distance.

Dive buoys also need an "anchor" line (sometimes called a buoy line) that may be played out from or taken back in to a storage device such as a reel or spool at the diver's option.

A dry storage compartment in the dive buoy can often eliminate numerous trips back to the diver's base often a boat or shore location.

U. S. Pat. No. 3,827,093 issued Aug. 23, 1974 to T. S. Davis discloses a spherical float having a circumferential groove in which the buoy line is stored. The wound line is covered and held within by means of an encircling band which acts as an unwinding break. During the course of the dive it is often desirable to re-spool portions of the buoy line to compensate for decreased depths. With this type of buoy it is impossible to re-spool the line to eliminate excess slack without returning to the surface. This represents a significant inconvenience since such frequent trips back and forth to the water surface decrease the diver's bottom time and, in fact, are potentially hazardous. Furthermore, there is no allowance for the required dive marker flag or a stabilizing depending counterweight assembly. Any addition of such required flag assemblies is precluded by the requirement of this dive buoy design that the line spool be in a vertical position to properly unwind.

U. S. Pat. No. 3,037,217 issued June 1962 to Mandra discloses a dive buoy structure comprising a spherical float with an integrated circumferential line spool about which the dive buoy line is stored. The line is retained on the spool by a resistive clip whose force must be overcome for each turn of line unspooled. With this type of buoy also, the diver is required to return to the surface to re-spool excess buoy line. It appears impossible to add the required dive flag assembly because the design of the buoy requires that the line spool be in a vertical position.

In U. S. Pat. No. 4,781,636 issued Nov. 1, 1988 to T. Schurr a portable marine buoy is disclosed wherein a marker flag and depending weight assembly are included with an integrated line spool. This type of buoy is not generally used by individual divers due to the anchor-type deployment. In most cases scuba divers clip the free end of the buoy line to their equipment and, in this case, they would still be required to return to the surface to make any adjustments in the length of the deployed buoy line.

U. S. Pat. No. 4,238,864 issued Dec. 16, 1980 to G. Kealoha integrates the concepts of a dive buoy line spool and dry storage compartment. In this design the line is retained on the spool by a pressure clip and the line is dispensed by overcoming the pressure clips retaining force. A dive flag structure is omitted. To add a dive flag to such a buoy appears impractical as the design of the buoy line spool requires it to be in a vertical position. If a protruding dive flag and corresponding stabilizing depending counterweight assembly were added, the line spool would be flipped into a horizontal position. In this position if force is applied to the buoy line in an attempt to overcome the resistive force of the retaining clip, the force would flip the flag assembly 90° into the water each time the diver attempts to deploy a length of line.

SUMMARY OF THE INVENTION

The present invention improves over the prior art in providing a dive buoy/dry box comprising a molded plastic canister main body having a hinged lid providing a water-tight storage compartment when the lid is closed. Detachably mounted circumferentially on the main body in a horizontal orientation is a line reel storing a dive buoy line of appropriate length.

A dive flag that may be supported in a full open position by foldable rod members is mounted to a foldable staff that may be detachably mounted to the buoy lid for display during dives. A lead weight mounted at the end of a foldable rod may be detachably attached to the bottom side of the buoy canister to stabilize the buoy and flat in an upright position when in the water. The flag, its folding mast, the stabilizing weights and its folding rod may all be stored in the dry box cavity in the buoy when not in use. An added feature is a thumb screw operated purge valve in the buoy lid allowing pressure equalization for easier opening of the dry box cavity.

BRIEF DESCRIPTION OF THE DRAWINGS

Drawings of a preferred embodiment of the invention are annexed hereto, so that the invention may be better and more fully understood, in which.

Numeral references are employed to designate like parts throughout the various figures of the drawing.

DETAILED DESCRIPTION OF THE INVENTION

Figure 1:
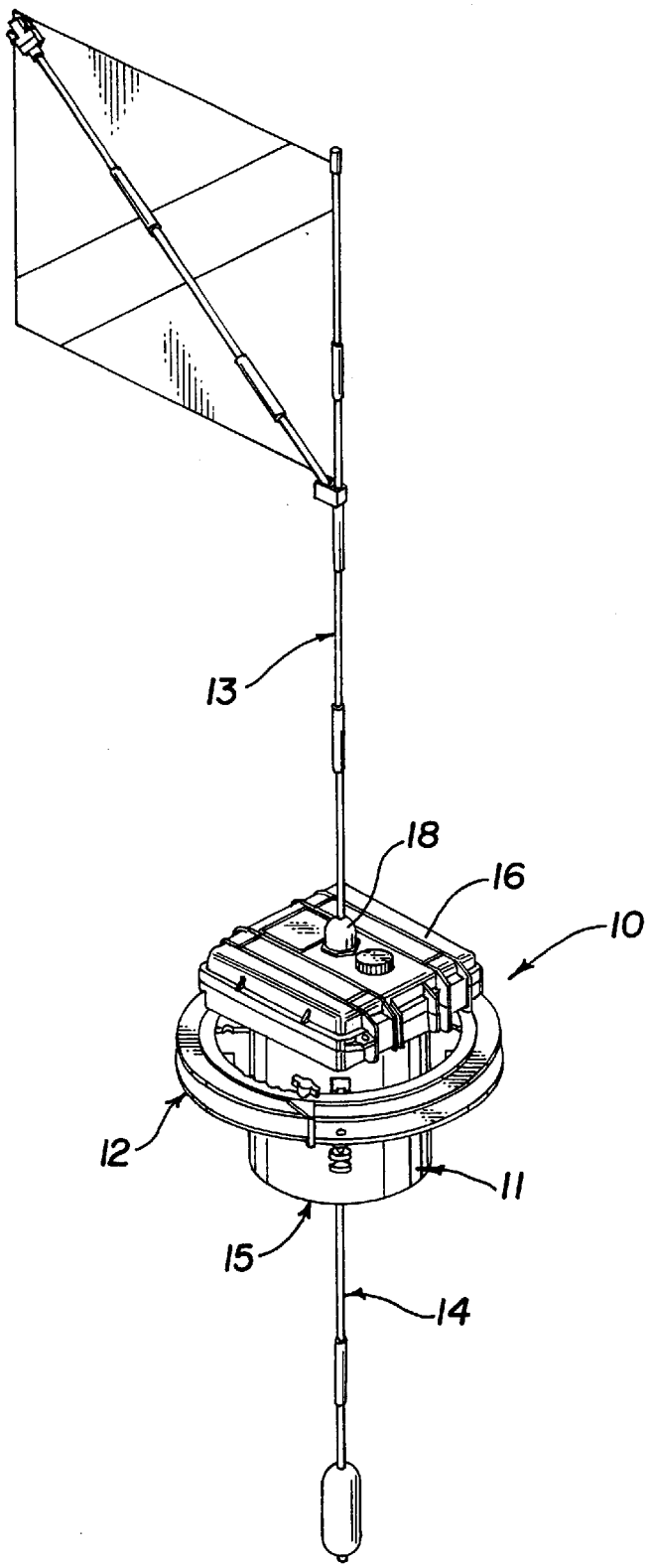
FIG. 1 is a view in perspective of the dive buoy of the present invention from slightly above when assembled for use.

Referring now to FIG. 1, there is shown in perspective view the diver marker buoy assembly 10 of the present invention. Assembly 10 comprises a float/dry box element 11 to which are detachably affixed a line reel 12, a collapsible marker flag assembly 13 and a collapsible counterweight ballast 14.

Counterweight ballast assembly 14 is detachably connected to the bottom side 15 of the float element 11 as by threaded engagements 17*a* and 17*b* (see FIG. 2) or any suitable form "snap-spring" attachment element. Marker flag assembly 13 is detachably connected to the top side of surface 16 of float element 11 as by threaded engagement 18 or suitable "snap-spring" attachment.

Line reel 12 with a buoy line wound thereon is detachably connected to the float element 11 near the upper end of the float and encircling it. Attachment may be by offset bearing couple 19 or other "quick-release" element. When attached to the float 11, reel 12 may be used as a carrying handle for the marker buoy assembly 10.

Figure 3:
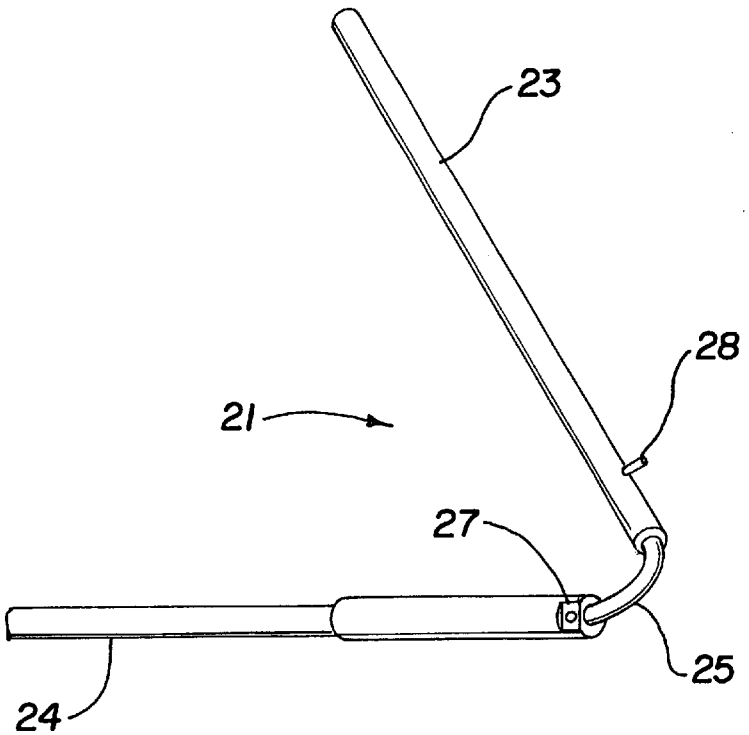
FIG. 3 illustrates in a perspective view the fold joint of the stabilizer rod and flag staff of the present invention.
Figure 2:
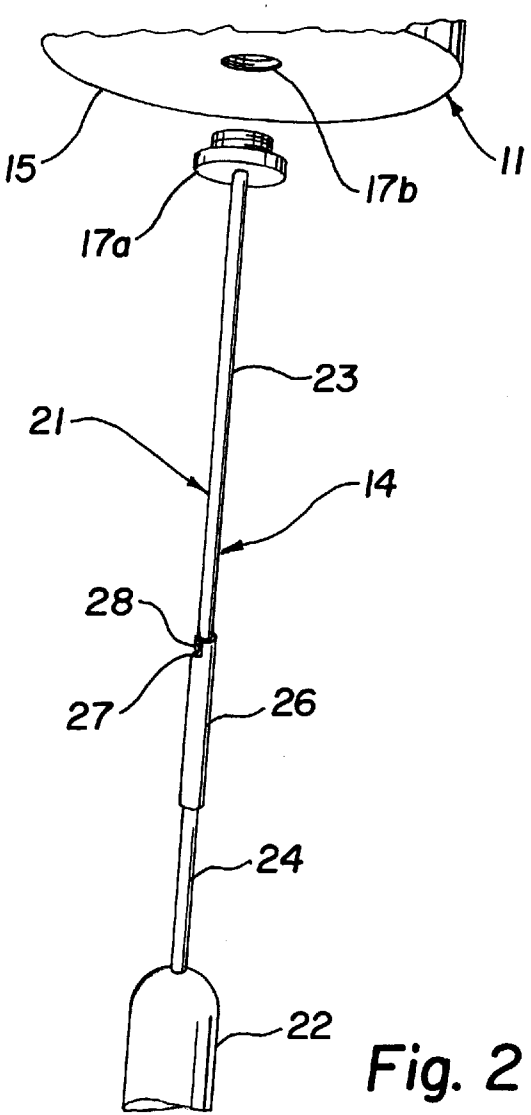
FIG. 2 is a view in perspective of the stabilizer weight and rod positioned for attachment to the dive buoy of the present invention.

Referring now to FIGS. 2 and 3, the counterweight ballast assembly 14 is comprised of a collapsible shaft 21. Shaft 21 has a counterweight such as a lead ingot 22 attached to one end thereof and a threaded plug element 17*a* affixed to the other end. Plug element 17*a* is threaded to match threads in recess 17*b* in the bottom surface 15 for attachment of the ballast assembly 14 to the float element 11.

Collapsible shaft 21 is comprised of a pair or more of tubular members 23 and 24 with an elastic cord 25 such as a Bunge cord connected internally between them in tension such that tubes 23 and 24 are urged together in alignment. A sleeve member 26 slideally surrounds tube 24. As shown in FIG. 2, sleeve 26 provides rigidity for shaft 21 in its straightened position when slid over the junction of the members 23 and 24 and latched with notch slot 27 and engaging pin 28 (see FIG. 3). Tubular units 23 and 24 and sleeve 26 may be made of fiberglass or other suitable plastic or metallic materials.

Figure 4:
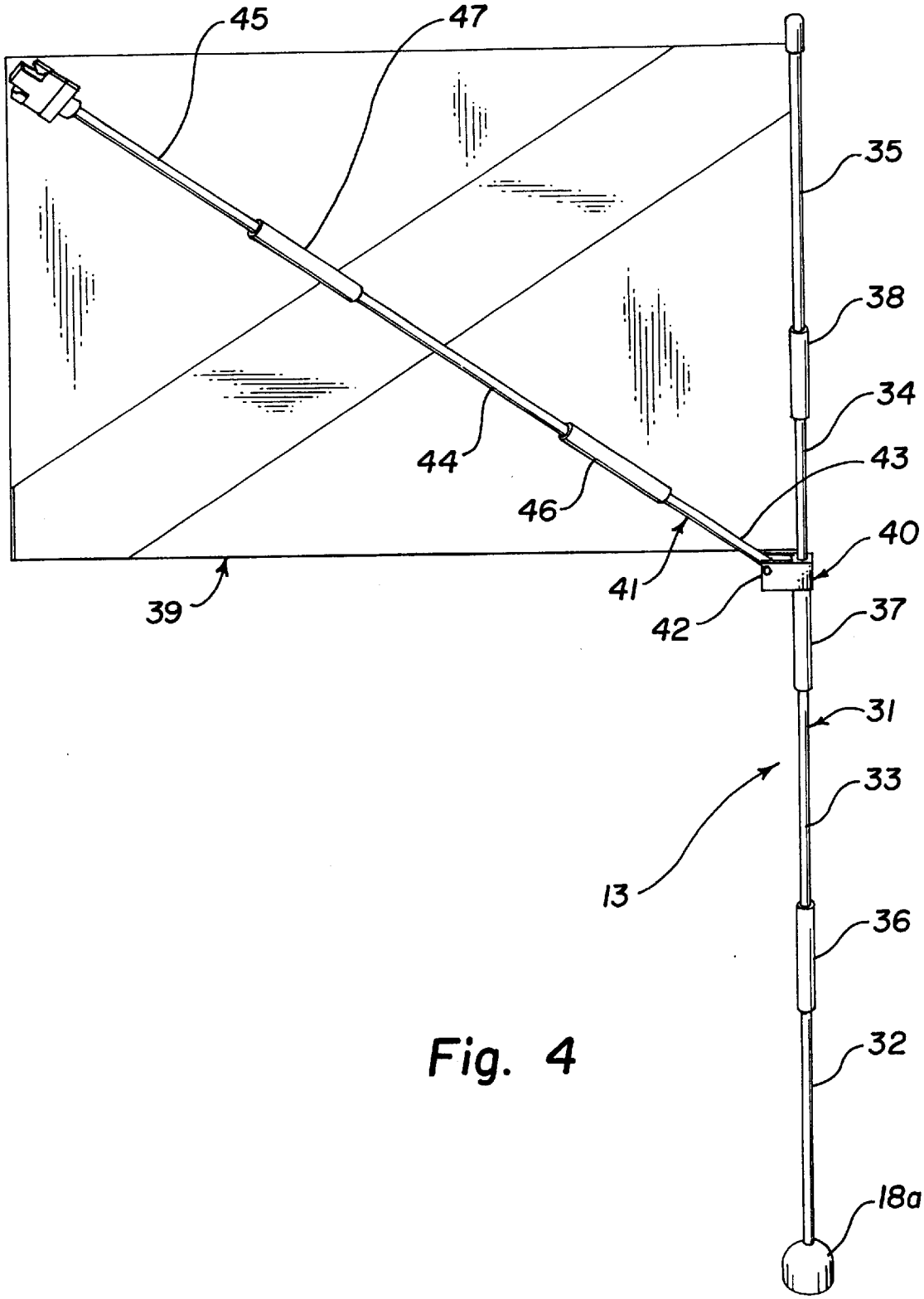
FIG. 4 is a view in elevation of the dive flag assembly of the present invention.

Turning now to FIG. 4, there is shown the collapsible marker flag assembly 13 of the present invention. Assembly 13 comprises a collapsible flag staff 31 having affixed at its lower end an internally threaded attachment 18*a* for affixing flag staff 31 to the externally threaded attachment stud 18b on the top surface 16 of float element 11. Elements 18*a* and 18*b* may be made of high impact plastic, corrosion-resistant metal or other suitable materials.

Attachment elements 18*a* and 18*b* are in "inverse" relationship to the attachments elements 17*a* and 17*b* for the ballast staff. That is, the plug member 17*a* is on the ballast staff but it is the recess member 18*a* that is attached to the flag staff. Thus, the ballast staff and the flag staff cannot be attached in the wrong locations. Other arrangements to prevent attachment of the flag staff or the ballast staff at incorrect locations on the float assembly may be used such as, for example, making the attachment means 17*a* and 17*b* structurally similar but of different size from the attachment means 18*a* and 18*b*.

Flag staff 31 may be of a design similar to the collapsible shaft 21. As shown, it comprises four tubular elements 32, 33, 34 and 35 of fiberglass urged together in alignment by one or more internally connected elastic cords, not shown. Three sleeves 36, 37 and 38 each slide over a joint between tubular units and when in place hold the tubular units aligned in a rigid staff. Sleeves 36, 37 and 38 are provided with internal obstructions or constrictions at approximately their mid-sections that prevent passage of the tubular units completely through the sleeve. Thus, when the staff 31 is being erected, the tubular units may be aligned in an upright position and pulled apart against the elastic cord. Then each of the sleeves is pulled by gravity down over the tubular unit below it. Each tubular unit is then guided into the sleeve below it so that a rigid staff is formed. The elastic bands or cords retain the tubular members seated in the sleeves. No latch slots are needed to hold the sleeves of staff 31 to the tubular units above them since, unlike the shaft 21, there is no weight tending to pull the tubular units apart.

To complete the marker flag assembly 13, a flag 39 is attached to upper staff units 34 and 35 just above the clamp 40. Flag 39 may be attached in any convenient way such as by sliding the upper tubular units of the staff through a sleeve in the flag or by tying the flag to the staff.

Clamp 40 pivotally mounts one end of flag extender rod 41 by means of pivot pin 42 extending through clamp 40 and rod 41. Extender rod 40 is a collapsible element of construction similar to the flag staff 31 and shaft 21 having three tubular members 43, 44, and 45 and two sleeves 46 and 47 and an internal elastic cord, not shown. The upper end of rod 41 is detachably affixed to the upper outer corner 48 of flag 39 by a quick-release latch element of a type commonly available as shown in FIGS. 5A and 5*b*.

Figure 5A:
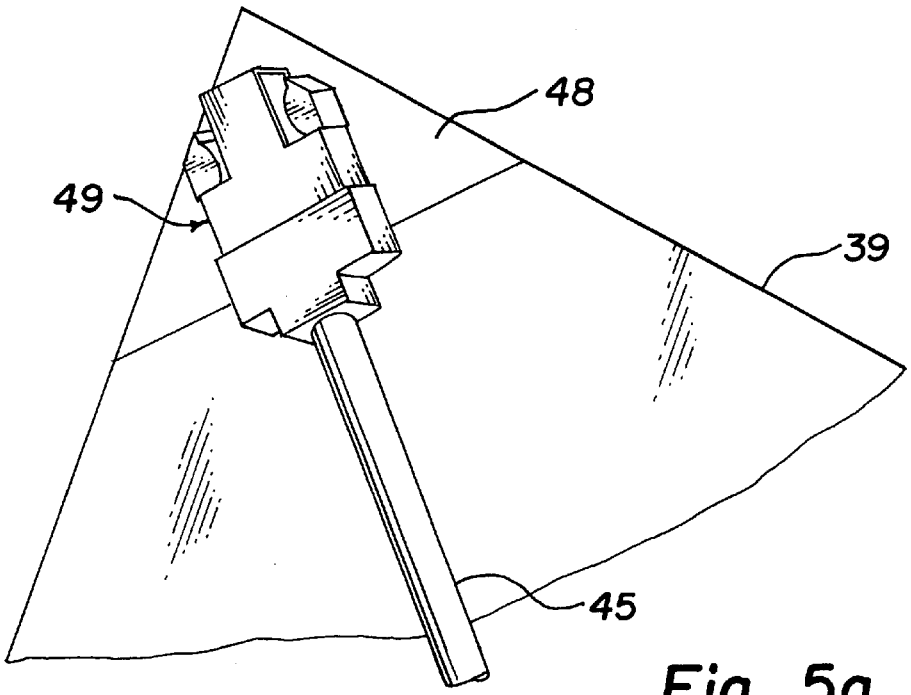
FIG. 5A and 5B illustrate the flag support latch of the present invention.
Figure 5B:
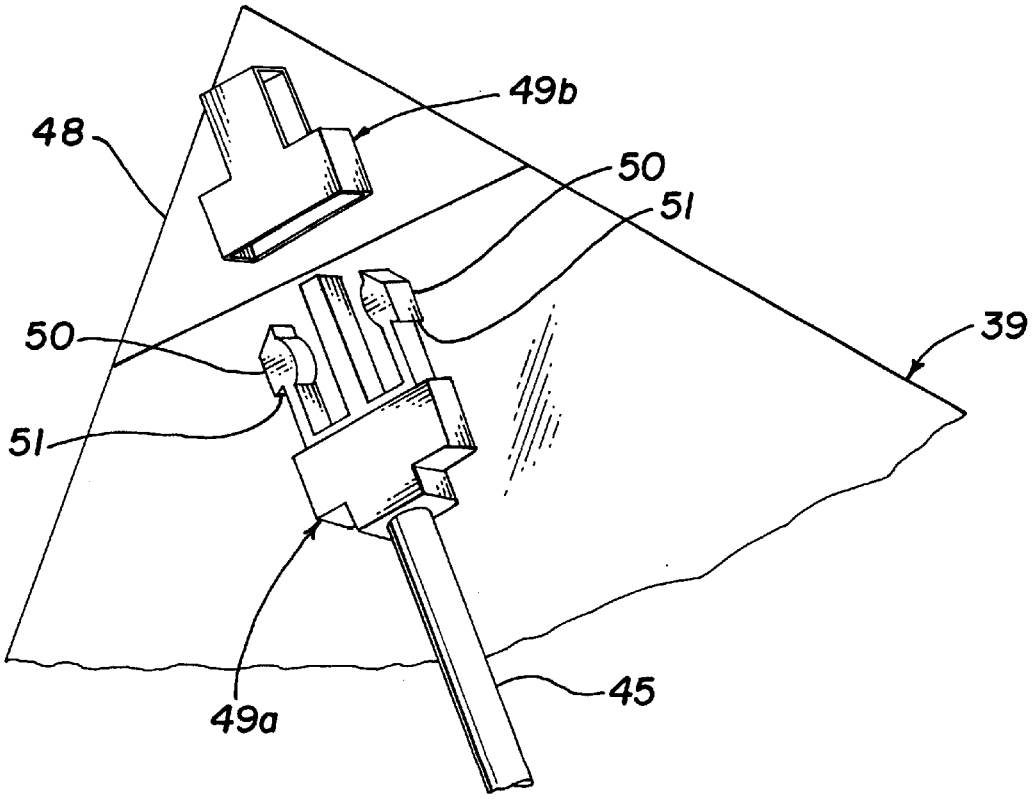

FIG. 5A shows element 49 in its latched position and FIG. 5B shows it in its unlatched position. The latch element 49 comprises an insert 49*a* and a receiver element 49*b*. These elements may be of a suitable metal or plastic. The tines 50 of insert 49*a* are flexible in their common plane and beveled along their outer sides from their outer ends to a shoulder 51 a short distance from their end. As the insert 49*a* is pushed into the receiver 49*b* the side walls of the receiver bear against the beveled sides flexing the tines inwardly until inserted far enough that the shoulders are passed the side walls of the receiver and spring out into the latched position as shown in FIG. 5A. Thumb and finger pressure to flex the tines inwardly allows the insert to be unlatched and easily removed from the receiver.

Figure 6:
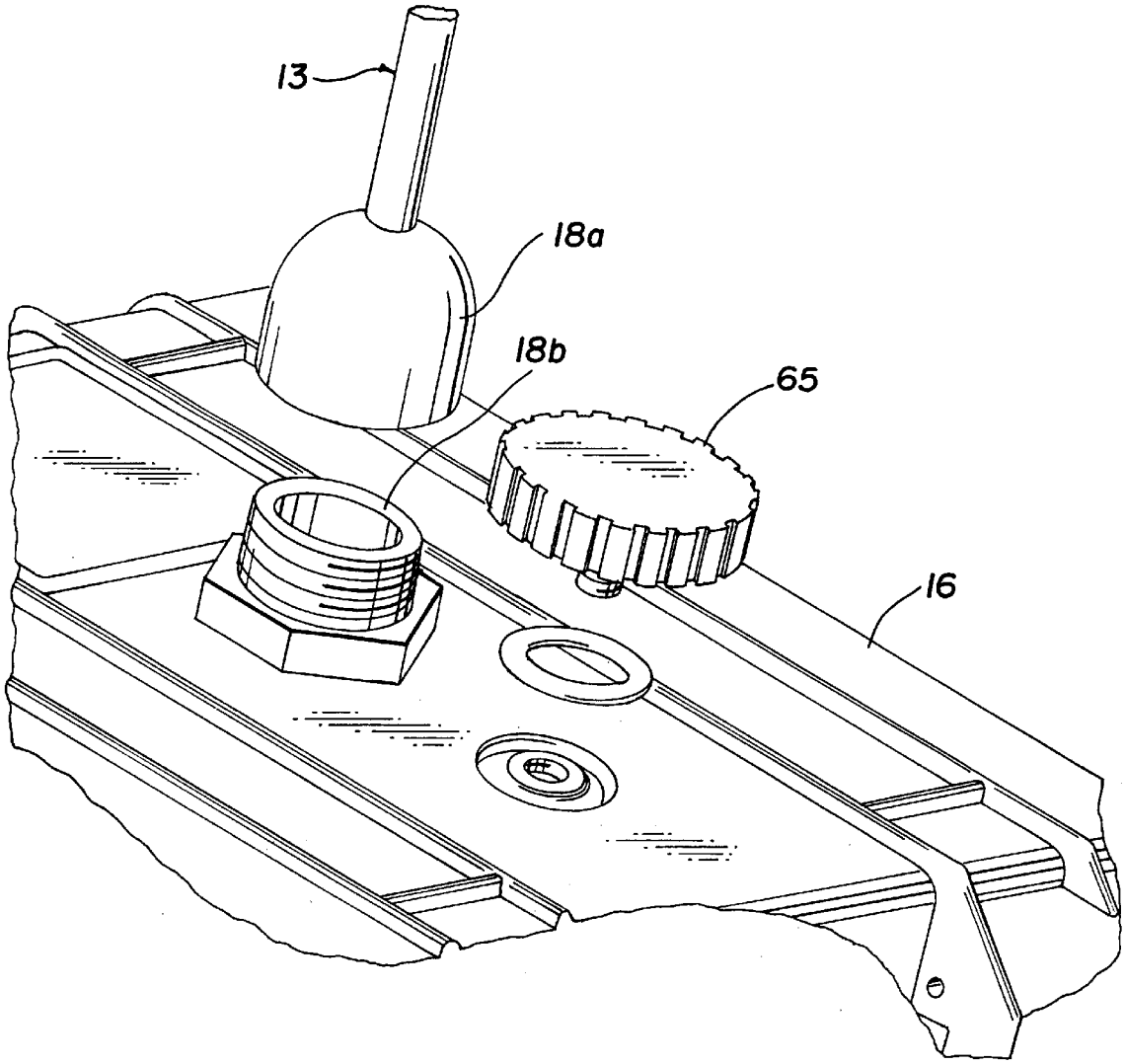
FIG. 6 is a partial view in perspective of the buoy lid of the present invention showing the flag attachment structure and the pressure equalization valve.

Shown in more detail in FIG. 6 are the threaded engagement elements 18*a* and 18*b* by which the staff of the marker flag assembly 13 is attached to the top surface 16 (i.e., the lid 54) of the float element 11.

Figure 7:
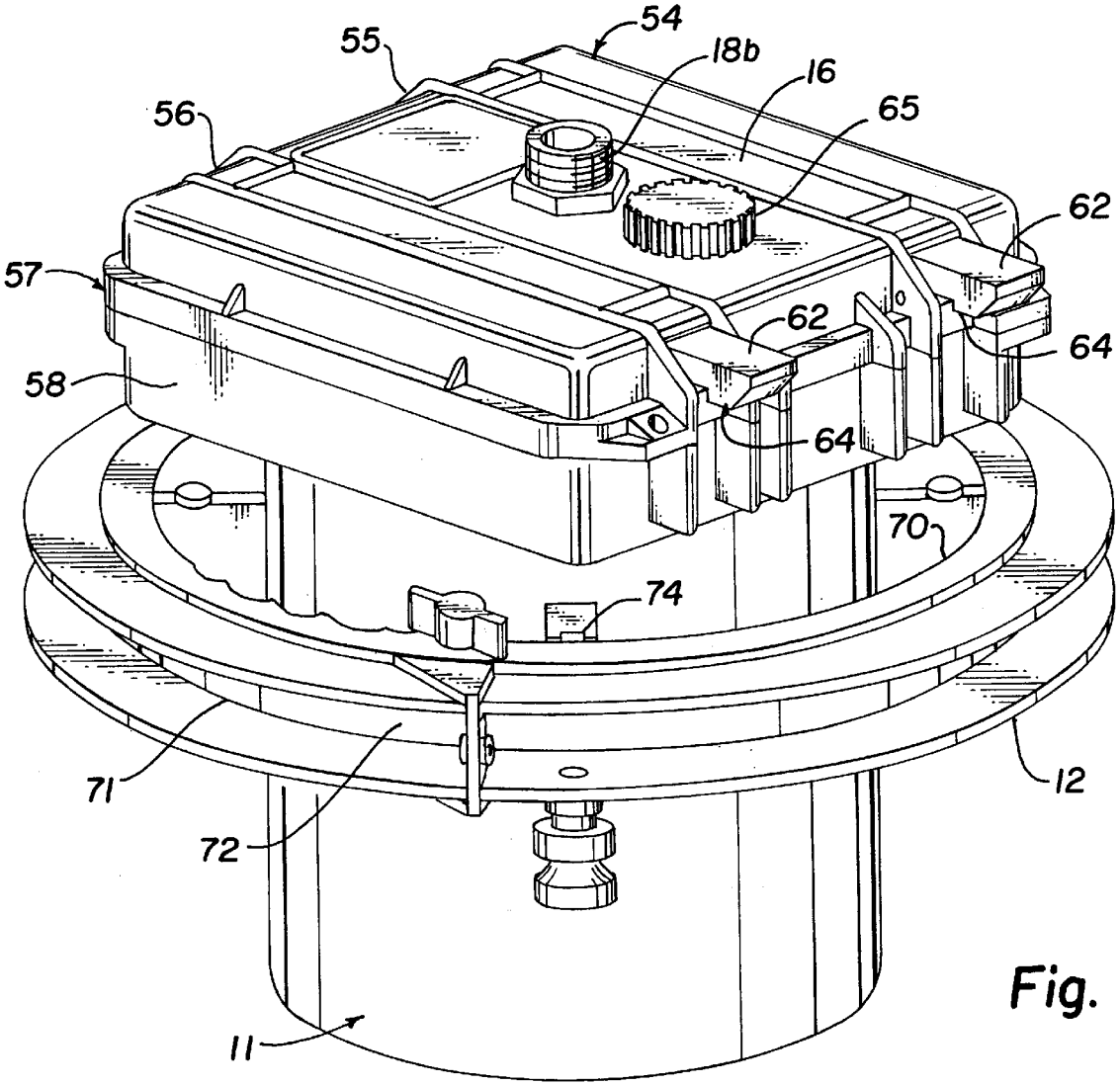
FIG. 7 is a view in perspective from above showing the buoy of the present invention with the lid closed and the line spool detached.
Figure 8:
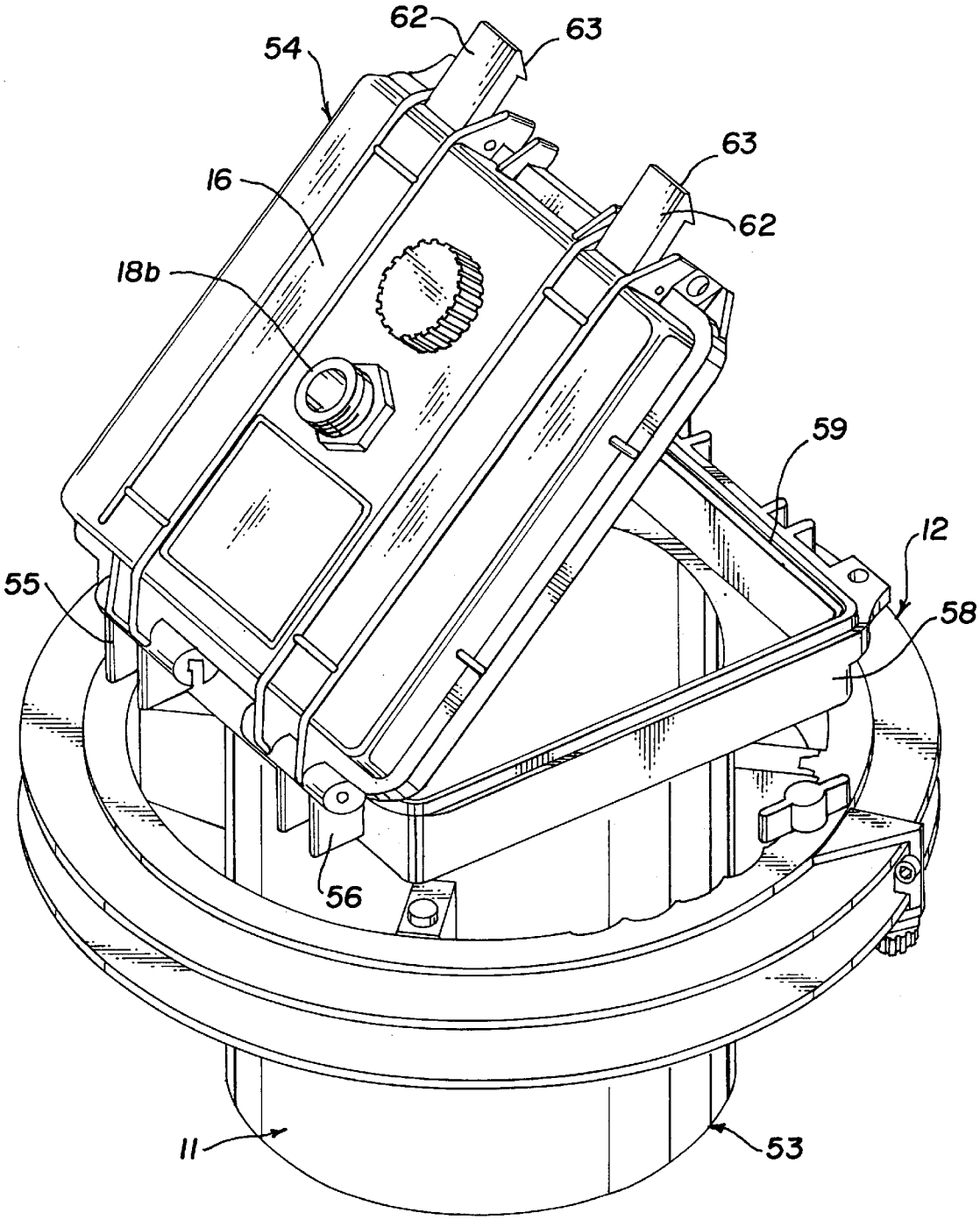
FIG. 8 is a view in perspective from above showing the buoy of the present invention with the lid open and the line spool attached.

Turning now to FIGS. 7 and 8, there is shown the main body of the marker buoy assembly 10 of the present invention being the float/dry box element 11. The float/dry box element 11 comprises a canister-like main section 53 of generally cylindrical configuration closed at its bottom end. The top end of section 53 terminates in a generally square or rectangular section 57 with a peripheral wall portion 58 extending a short distance up from the level at which section 57 meets section 53.

A sealing lid 54 is attached by hinges 55 and 56 to the section 57 as shown. Wall portion 58 has an upstanding ridge 59 along the full circumferential length of its upper edge. Sealing lid 54 is equipped with a groove 60 around its lower surface just inside its peripheral edge configured to match the line of and receive within it the ridge 59 of wall section 58. An elastic sealing ring 61 which may be of rubber or neoprene, such as an "o" ring of appropriate size is provided within the groove 60 around its entire length so that upon closure of the lid 54 ridge 59 is pressed against the sealing ring 61 in groove 60 to provide an air/water-tight seal between the lid 54 and the canister portion 57 of the float element assembly 11.

Both the main section 53 and the lid 54 may each be made of any appropriate plastic material or any other plastic material. Preferably both the main section 53 and the lid 54 are of molded polypropylene.

One or more latch elements 62 (two are shown) are provided on the side of lid 54 opposite the hinges 55 and 56.

Each latch element 62 may be hingeably attached to lid 54 and provided with a lip 63 configured to slide over and grip shoulder 64 appropriately positioned on the upper section 57 of canister 53 to hold lid 54 closed with a air/water-tight seal against canister 53.

Optionally provided in lid 54 is vent valve operated by thumb screw 65. Opening of the vent valve allows the pressure within the float assembly to be equalized with the external atmospheric pressure to allow easy opening of the sealed canister lid after a change in altitude, for example.

Line reel 12 is detachably affixed to the canister main section 53 by suitable quick-disconnect means such as a pair of "spring-loaded bearings."

Line reel 12 is comprised of an inner bearing race ring 70 upon which is rotatably mounted outer spool ring 71 that carries a supply 72 of dive buoy line of the usual type and material wound thereon. The exact means by which spool ring is affixed to the inner bearing race ring 70 is immaterial to the present invention.

Line reel 12 is detachably attached to the canister main section 53 and surrounding the canister section, as shown. Attachment may be by means of a pair of spring-loaded bearing snaps 73 positioned on opposite sides of the ring 70 to engage (fastener bases) 74 positioned on opposite sides of the canister section 53. A pair of shoulder elements 75 with guide slots are positioned on opposite sides of the ring 70 90° from the fastener 73 to match and engage shaped guide studs 76 mounted in appropriate positions on the canister section 53.

Thus, there has been described a compact dive buoy/dry box for divers providing in use, a stabilized marker flat displayed at appropriate height, an accessible dry storage compartment and a buoy line on a storage reel suitable for lengthening or shortening by the diver without the necessity of his returning to the buoy. The assembly also provides, when not in use, a storage compartment for the collapsible marker flat and its staff and a ballast element and its collapsible attachment rod. The reel for buoy line provides a convenient handle for carrying the buoy assembly when attached to the assembly in its storage position.

Having described the invention, I claim:

1. A dive buoy/dry box assembly comprising:

a hollow float assembly of canister-like configuration having a closed lower end and an open upper end, a sealing lid in hinged attachment proximate to said upper end, said lid adapted to close said upper end in fluid-tight sealing engagement therewith and latch means for releasably maintaining said lid in said sealing engagement;

collapsible pole-like marker staff having a marker flag means mounted at one end thereof and attachment means mounted at the opposite end thereof for detachably affixing said marker staff to said sealing lid;

a collapsible pole-like ballast staff having a ballast weight mounted at one thereof and attachment means mounted at the opposite end thereof for detachably affixing said ballast staff to said closed lower end of said float assembly; and a buoy line storage reel detachably mounted on said float assembly surrounding said float assembly, said storage reel when so mounted having its axis of rotation disposed in a plane generally parallel to a plane of said ballast staff when said ballast staff is affixed to said float assembly.

2. The dive buoy/dry box assembly as defined in claim 1 wherein said marker staff, said marker flag and said ballast staff are each collapsible to a size allowing said marker staff, said ballast staff and said marker flag to be stored together within said float assembly with said lid closed and latched.

3. The dive buoy/dry box assembly as defined in claim 1 wherein said marker flag comprises collapsible stiffening elements for retaining said marker flag in an extended display position.

4. The dive buoy/dry box assembly as defined in claim 1 wherein said float assembly including said lid is comprised of molded polypropylene.

5. The dive buoy/dry box assembly as defined in claim 1 wherein said lid includes an externally threaded protrusion from a top surface thereof and said attachment means mounted on said marker staff comprises an internally threaded recess for matching engagement with said threaded protrusion.

6. The dive buoy/dry box assembly as defined in claim 5 wherein said closed lower end of said float assembly includes an internally threaded recess and said attachment means mounted on said ballast staff comprises an externally threaded element for matching engagement with said internally threaded recess of said lower end of said float assembly.

7. The dive buoy/dry box assembly as defined in claim 1 wherein said lid includes an internally threaded recess and said attachment means mounted on said marker staff comprises an externally threaded element for matching engagement with said internally threaded recess and said closed lower end of said float assembly includes an internally threaded recess of a different size from said lid recess and said attachment means mounted on said ballast staff comprises an externally threaded element of a size for matching engagement with said recess of said lower end of said float assembly.

8. The dive buoy/dry box assembly as defined in claim 1 wherein said collapsible marker staff and said collapsible ballast staff are each comprised of a plurality of fiberglass tubing sections urged together in alignment by internally connected elastic bands in tension.

9. The dive buoy/dry box assembly as defined in claim 8 wherein said plurality of fiberglass tubing sections are locked in alignment in each of said marker staff and said ballast staff by a plurality of sleeve members each adapted for slideable positioning over an aligned engagement between an adjacent pair of said plurality of tubing sections.

10. A dive buoy/dry box assembly comprising:

a hollow float assembly of canister-like configuration having a closed lower end and an open upper end, a sealing lid in hinged attachment proximate to said upper end and adapted to close said upper end in fluid-tight sealing engagement therewith and latch means for releasably maintaining said lid in said sealing engagement with said upper end, said float assembly and said sealing lid being comprised of polypropylene plastic;

a collapsible pole-like marker staff having marker flag means mounted at one end thereof and attachment means mounted at the opposite end thereof for detachably affixing said marker staff to said sealing lid, a collapsible pole-like ballast staff having a ballast weight mounted at one end thereof and attachment means mounted at the opposite end thereof for detachably affixing said ballast staff to said closed lower end of said float assembly, said attachment means on each said marker staff and said ballast staff each comprising threaded engagement means for engaging mating threaded engagement means appropriately located on said float assembly, said attachment means on said marker staff being sufficiently physically different from said attachment means on said ballast staff to prevent either of said staffs from being incorrectly attached in place of the other of said staffs, said marker staff and said ballast staff being comprised of a plurality of fiberglass tubing sections urged together in aligned engagement by internally connected elastic bands; and a buoy line storage reel detachably mounted on said float assembly surrounding said float assembly, said storage reel when so mounted having its axis of rotation disposed in a plane generally parallel to a plane containing said ballast staff when said ballast staff is affixed to said float assembly.

11. The dive buoy/dry box assembly as defined in claim 10 wherein said marker flag includes collapsible stiffening elements for retaining said marker flag in an extended display position.

12. The dive buoy/dry box assembly as defined in claim 11 wherein said marker flag staff, said ballast staff and said flag stiffening elements are collapsible to sizes allowing said flag staff, said flag and said ballast staff and ballast all to be stored within said hollow float assembly.

13. The dive buoy/dry box assembly defined in claim 12 wherein said sealing lid further comprises a relief valve means for equalizing internal and external gas pressures of said float assembly.

* * * * *